US007210197B2

(12) United States Patent
Fedorka et al.

(10) Patent No.: US 7,210,197 B2
(45) Date of Patent: May 1, 2007

(54) NOZZLE ASSEMBLY WITH AIR FLOW ACCELERATION CHANNELS

(75) Inventors: Thomas J. Fedorka, Danville, KY (US); Jason R. Gieske, Danville, KY (US); Jason D. Bowden, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 556 days.

(21) Appl. No.: 10/806,912

(22) Filed: Mar. 23, 2004

(65) Prior Publication Data

US 2004/0187254 A1 Sep. 30, 2004

Related U.S. Application Data

(60) Provisional application No. 60/457,432, filed on Mar. 25, 2003.

(51) Int. Cl.
*A47L 9/02* (2006.01)
*A47L 9/04* (2006.01)

(52) U.S. Cl. ..... 15/420; 15/415.1

(58) Field of Classification Search ..... 15/415.1, 15/420

See application file for complete search history.

(56) References Cited

U.S. PATENT DOCUMENTS

| | | | | |
|---|---|---|---|---|
| 1,785,675 | A | 12/1930 | Cundiff | |
| 2,321,648 | A | 6/1943 | Brunner, Jr. | |
| 3,550,183 | A * | 12/1970 | Wolf | 15/420 |
| 4,315,344 | A | 2/1982 | Woodward et al. | |
| 5,987,700 | A | 11/1999 | Edlund | |
| 6,105,207 | A | 8/2000 | Muller | |
| D440,721 | S | 4/2001 | Hirokawa | |
| 6,421,875 | B1 * | 7/2002 | Coombs et al. | 15/420 |
| 2006/0000053 | A1 * | 1/2006 | Lim et al. | 15/415.1 |

* cited by examiner

*Primary Examiner*—Theresa T. Snider
(74) *Attorney, Agent, or Firm*—King & Schickli, PLLC

(57) ABSTRACT

A nozzle assembly is provided for a suction cleaning device. The nozzle assembly includes a body having an edge and a bottom wall. The bottom wall includes an intake opening and a portion extending between the edge and the intake opening. At least one channel is provided within that portion. That channel extends between the edge and the intake opening and has a cross sectional area decreasing in a direction extending from the edge toward the intake opening. Air drawn through the channel is accelerated as it approaches the intake opening in order to increase the dirt, dust and debris entraining capacity of that air and overall vacuum cleaner cleaning efficiency.

19 Claims, 4 Drawing Sheets

NOZZLE ASSEMBLY WITH AIR FLOW ACCELERATION CHANNELS

This application claims the benefit of U.S. Provisional Patent Application Ser. No. 60/457,432 filed on Mar. 25, 2003.

TECHNICAL FIELD

The present invention relates generally to the floor care equipment field and, more particularly, to a nozzle assembly for a suction cleaning device equipped with channels for directing and accelerating the flow of air toward the intake opening of the nozzle assembly. The invention also relates to upright vacuum cleaners, power heads and nozzle attachments incorporating such a feature.

BACKGROUND OF THE INVENTION

Floor care cleaning equipment including upright and canister vacuum cleaners as well as power nozzles and nozzle attachments for such vacuum cleaners as well as extractors are all very well known in the art. Each of these devices incorporates a suction generator for drawing an airstream into an intake opening in the nozzle. Dust, dirt and debris from an underlying surface such as a carpet, rug or bare floor become entrained in the airstream and are drawn into the intake opening. The dust, dirt and debris are separated from the airstream in the vacuum cleaner and collected in a dirt collecting vessel such as a cup, container or bag and the clean air is then subjected to final filtration before being exhausted into the environment.

Whether the cleaning equipment in question operates utilizing cyclonic airflow principles or is non-cyclonic or utilizes a bag or a cup, the velocity of the airstream being drawing into the intake opening has a significant effect on the cleaning efficiency of the device. Specifically, the greater the velocity of the airstream being drawn into the intake opening, the greater the capacity of that airstream for carrying dirt into the device and toward the dirt collection vessel.

The present invention relates to a nozzle assembly for a suction cleaning device incorporating structures adapted to accelerate the airstream as it approaches the intake opening and thereby increase cleaning efficiency.

SUMMARY OF THE INVENTION

In accordance with the purposes of the present invention as described herein, an improved nozzle assembly is provided for a suction cleaning device. That nozzle assembly includes a body having an edge and a bottom wall. The bottom wall includes an intake opening and a portion extending between the edge and the intake opening. At least one channel is provided in that portion. That channel extends at least partially between the edge and the intake opening. That channel also has a cross-sectional area deceasing in a direction extending from the edge toward the intake opening whereby air drawn through the channel is accelerated as the air approaches the intake opening.

In one possible embodiment the channel includes a top wall and a pair of converging sidewalls. Thus, the channel may be a substantially truncated V-shape.

In any of the possible embodiments the channel includes a first end adjacent the edge and a second end adjacent the intake opening. The first end has a width $W_1$ and the second end has a width $W_2$ where $W_1>W_2$. Similarly, the first end may have a depth $D_1$ and the second end may have a depth $D_2$ where $D_1>D_2$.

In accordance with still another aspect of the present invention, multiple channels may be provided. In such a structure each of those channels may include a top wall and a pair of converging sidewalls. Thus, each of the channels may be a substantially truncated V-shape.

Each of the channels may include a first end adjacent the edge and a second end adjacent the intake opening. As noted above, the first end has a width $W_1$ and the second end has a width $W_2$ where $W_1>W_2$. Additionally, the first end may have a depth $D_1$ and the second end may have a depth $D_2$ where $D_1>D_2$.

The portion may have an overall width $W_3$ and the first ends of the multiple channels have a total combined width $W_4$ where $W_4$ is between about 40% to about 60% of $W_3$. The second ends of the multiple channels have a total combined width $W_5$ where $W_5$ is between about 22% to about 42% of $W_3$.

In accordance with yet another aspect of the present invention, a method is provided for increasing cleaning efficiency of a nozzle assembly including an intake opening. That method includes the step of providing an air inlet channel in the nozzle assembly for delivering air to the intake opening. Additionally, the method includes the step of accelerating air traveling through the air inlet channel as it approaches the intake opening. This is accomplished by gradually reducing the cross sectional area of the air inlet channel as it approaches the intake opening.

In accordance with yet another aspect of the present invention, an upright vacuum cleaner is provided. That upright vacuum cleaner includes a nozzle assembly having a bottom wall defining an intake opening and a canister assembly pivotally connected to the nozzle assembly. A suction generator is mounted in either the nozzle assembly or the canister assembly. Similarly, a dirt collection vessel is mounted in either the nozzle assembly or the canister assembly.

The nozzle assembly is characterized by having at least one channel in the bottom wall thereof in communication with the intake opening. That at least one channel has a cross sectional area decreasing in a direction extending toward the intake opening. Of course, the upright vacuum cleaner may also include a rotary agitator in the intake opening. Such an agitator rotates relative to the nozzle assembly and brushes, bristles, beater bars, wipers and/or other structures contained thereon sweep and beat dirt and debris from an underlying surface such as the nap of a carpet being cleaned.

In accordance with yet another aspect of the present invention a power head is provided. That power head comprises a nozzle assembly having a bottom wall defining an intake opening. Additionally, the power head includes a rotary agitator carried on the nozzle assembly and extending at least partially across the intake opening. At least one channel in the bottom wall is provided in communication with the intake opening. That channel has a cross sectional area decreasing in a direction extending toward the intake opening.

Finally, the invention includes a nozzle attachment. That nozzle attachment comprises a nozzle body having a bottom wall defining an intake opening and at least one channel in the bottom wall in communication with the intake opening. That channel has a cross sectional area decreasing in a direction extending toward the intake opening. Accordingly, air passing through the channel is accelerated as it is drawn into the intake opening. The accelerated air has the capability of entraining more dirt and debris and thereby increases the cleaning efficiency of the vacuum cleaner for a suction generator having a particular size motor.

Still other objects of the present invention will become readily apparent to those skilled in this art from the following description wherein there is shown and described a preferred embodiment of this invention simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention, and together with the description serves to explain certain principles of the invention. In the drawing.

Reference will now be made in detail to the present preferred embodiment of the invention, an example of which is illustrated in the accompanying drawing.

DETAILED DESCRIPTION OF THE INVENTION

Figure 1:
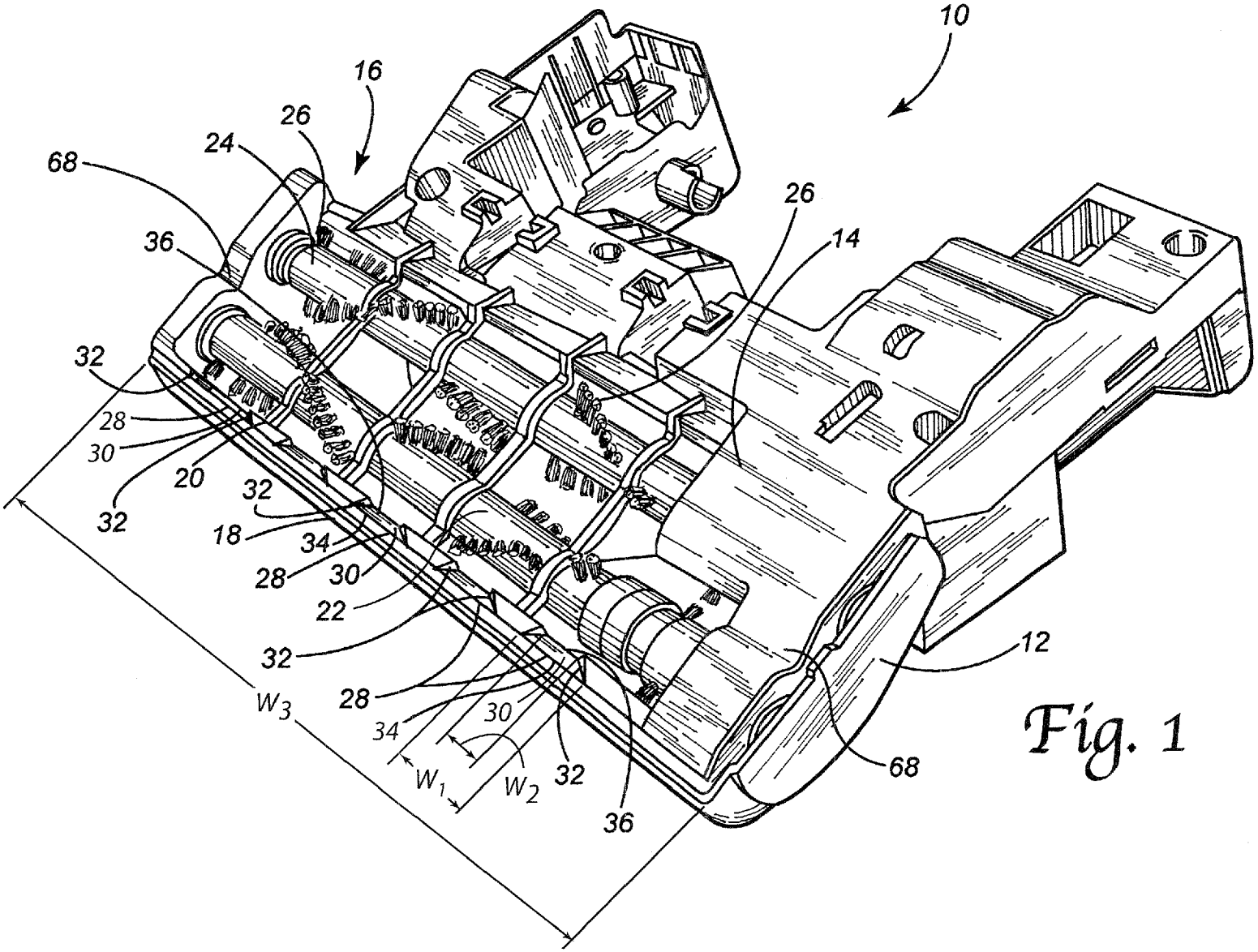
FIG. 1 is a perspective view of a nozzle assembly clearly illustrating the bottom wall thereof, the intake opening defined by the bottom wall, an edge of the nozzle assembly and the margin of the bottom wall extending between the edge and the intake opening.

Reference is now made to FIG. 1 showing the nozzle assembly of the present invention generally designated by reference numeral 10. The nozzle assembly 10 includes a body 12 having a bottom wall 14 that defines an intake opening 16. The body 12 also includes an edge 18 illustrated as the front or leading edge. The bottom wall 14 also includes a portion 20 extending between the edge 18 and the intake opening 16.

In the illustrated embodiment, two rotary agitators 22, 24 are carried on the nozzle assembly 10 and extend across the intake opening 18. During operation of the vacuum cleaner the rotary agitators 22, 24 are rotated relative to the nozzle assembly 10. Tufts of bristles 26 project from the agitators 22, 24. As the agitators 22, 24 rotate, the bristle tufts 26 engage the nap of an underlying rug or carpet and beat dirt and debris from that carpet. Air is drawn by a suction generator into the intake opening 16. Dirt and debris loosened from the rug or carpet becomes entrained in that airstream and is drawn through the intake opening 16 into a dirt collection vessel such as a cup or bag where it is collected for disposal.

As should be appreciated, the cleaning efficiency of the vacuum cleaner is largely determined by two factors: (1) the effectiveness of the bristle tufts 26, beater bars, wipers or other associated structure or structures to free dirt and debris from a rug or carpet, and (2) the speed and volume of the airstream which determines the effectiveness of the airstream to entrain dust, dirt and debris and draw it into the vacuum cleaner. The present invention serves to increase the speed of the airstream and, consequently, maximize the load carrying capacity of the airstream. In this way the cleaning efficiency of the vacuum cleaner may be significantly enhanced.

In order to improve the cleaning efficiency of the nozzle assembly 10, a series of channels 28 are provided in the portion 20 of the bottom wall 14. The channels 28 include a top wall 30 and a pair of opposing sidewalls 32. As further illustrated the channels 28 include a first end 34 adjacent the front edge 18 of the nozzle assembly 10 and a second end 36 adjacent the inlet opening. Thus, each channel 28 extends uninterrupted from the edge 18 to the intake opening 16. Further, it should be appreciated that the sidewalls 32 converge in a direction moving from the edge 18 toward the intake opening 16. Thus, the cross sectional area of each channel 28 decreases in a direction extending from the edge 18 toward the intake opening 16. Accordingly, air being drawn into the first end 34 of each channel 28 must pass through an ever narrowing space and as a result that air is accelerated as it approaches the second end 36 and passes into the intake opening 16. The resulting accelerated airstream has the capability of entraining both a greater volume and weight of dust, dirt and debris which is then drawn into the floor cleaning device with increased cleaning efficiency.

Figure 2:
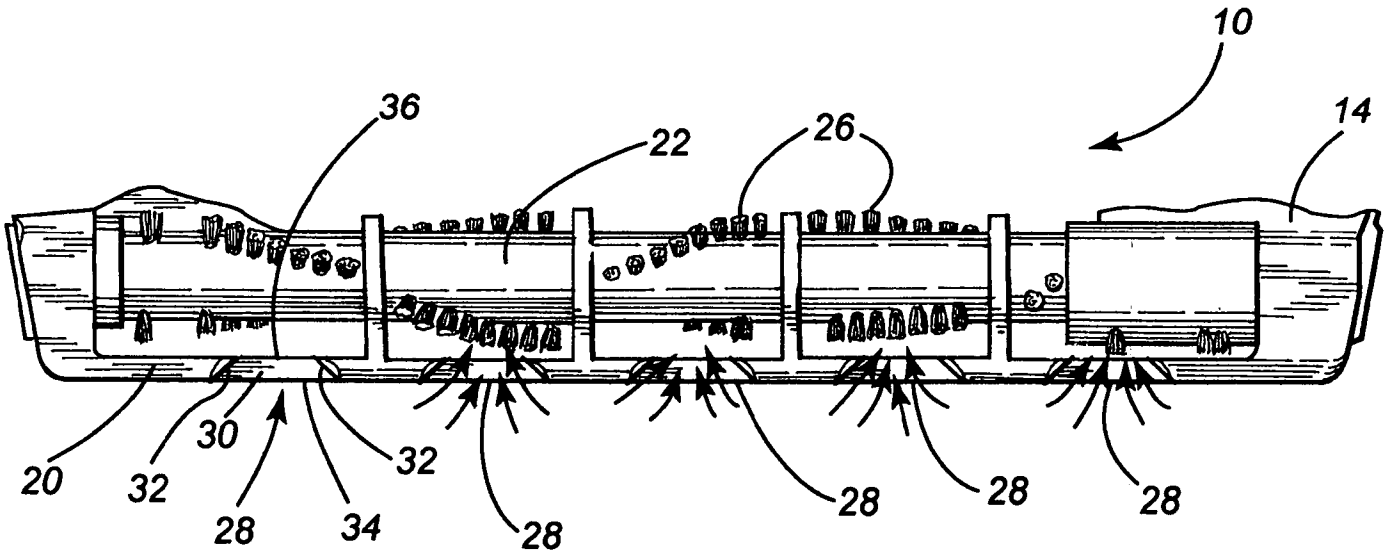
FIG. 2 is a detailed plan view illustrating the bottom wall of the nozzle assembly shown in FIG. 1 including the channels extending from the edge to the intake opening.

While substantially truncated V-shaped channels 28 are illustrated in FIGS. 1 and 2, it should be appreciated that substantially any channel shape providing a cross-sectional area decreasing in a direction toward the intake opening could be utilized.

Figure 3:
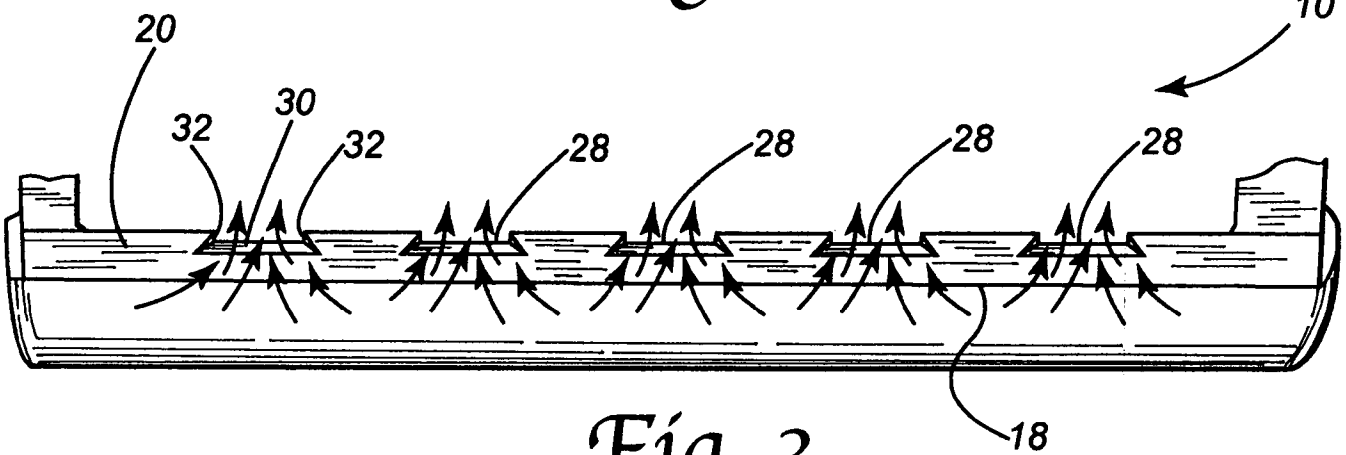
FIG. 3 is an inverted front elevational view illustrating the nozzle assembly of FIGS. 1 and 2 incorporating the features of the present invention.

In the embodiment illustrated in FIGS. 1–3, the first end 34 of each channel 28 has a width $W_1$ and the second end 36 of each channel has a width $W_2$ where $W_1>W_2$. While not specifically illustrated, the first end 34 of each channel 28 could have a depth $D_1$ while the second end 36 of each channel could have a depth $D_2$ where $D_1>D_2$. Thus, it should be appreciated that it does not matter which channel dimensions change so long as the overall cross-sectional area of the channel decreases in a direction moving toward the intake opening 16 so as to promote acceleration of the airstream.

In the embodiment illustrated in FIG. 1 five channels 28 are shown in the portion 20. The portion 20 has a width $W_3$ and the first ends 34 of the multiple channels 28 have a total combined width $W_4$ where $W_4$ is between about 40% to about 60% of $W_3$. Further, the second ends 36 of the multiple channels have a total combined width $W_5$ of between about 22% to about 42% of $W_3$.

While five channels 28 are illustrated, it should, of course, be appreciated that substantially any other reasonable number of channels could be provided from, for example, one to perhaps 20 or more. The key is providing one or more inlet air channels 28 in the nozzle assembly 10 for freely delivering air to the intake opening 16 having a geometry adapted for accelerating the air traveling through the channels 28 as that air approaches the intake opening.

Figure 4:
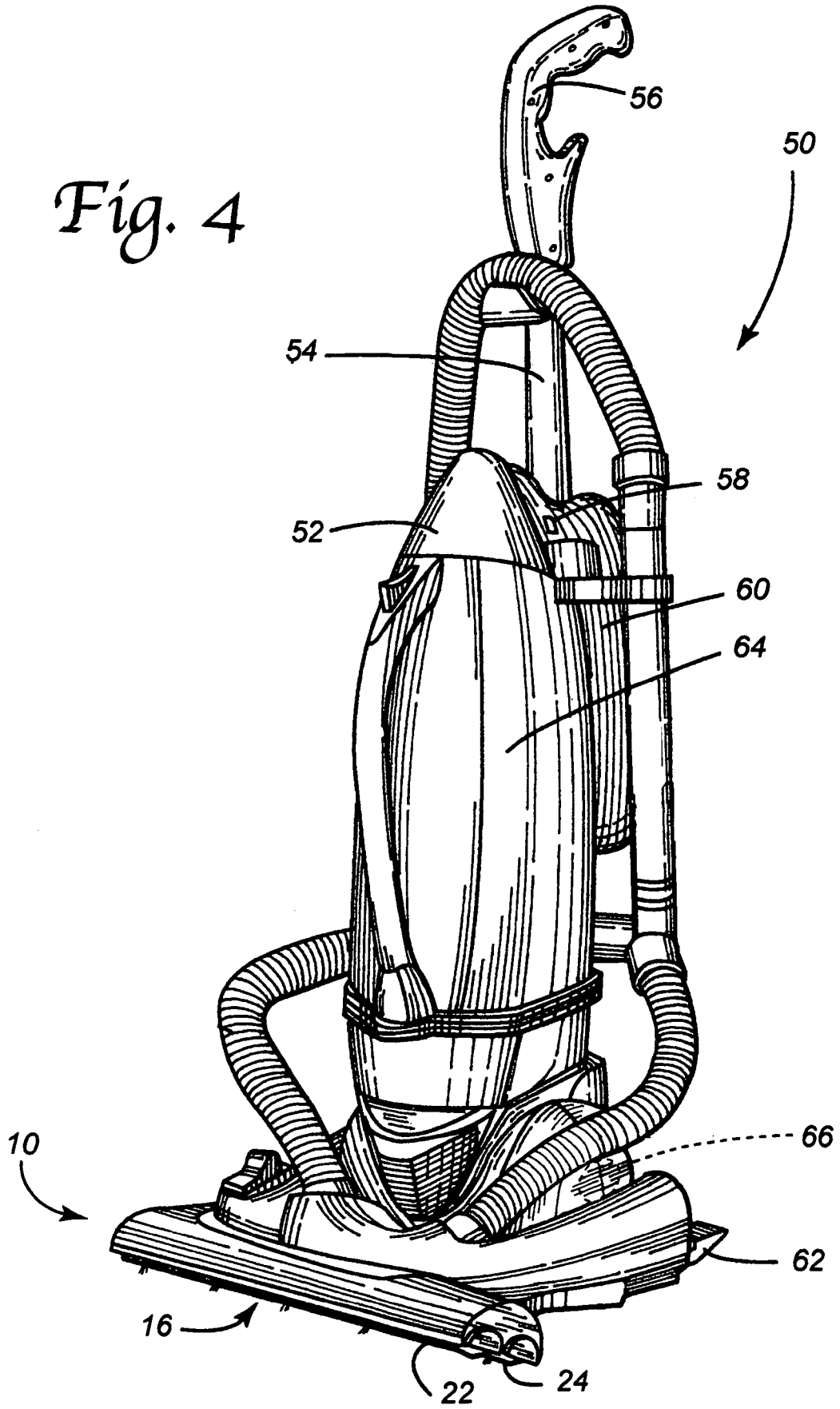
FIG. 4 is a perspective view illustrating an upright vacuum cleaner incorporating the nozzle assembly of the present invention.

FIG. 4 illustrates an upright vacuum cleaner 50 incorporating the nozzle assembly 10 of the present invention. More specifically, the upright vacuum cleaner 50 includes a housing comprising the nozzle assembly 10 and a canister assembly 52 that is pivotally connected to the nozzle assembly. As illustrated the canister assembly 52 includes a control handle 54 and a hand grip 56. A control switch 58 is provided for turning the upright vacuum cleaner on and off. Of course, electrical power is supplied to the vacuum cleaner 50 from a standard electrical wall outlet through an electrical cord 60.

As is well known in the art, a pair of rear wheels (not shown) are provided on a lower portion of the canister assembly 52 and a pair of front wheels (also not shown) are provided on the nozzle assembly 10 for movement across the floor. To allow for convenient storage of the vacuum cleaner, a foot latch 62 functions to lock the canister assembly 52 in an upright position as shown in FIG. 4. When the foot latch 62 is released, the canister assembly 52 may be pivoted relative to the nozzle assembly 10 as the vacuum cleaner 50 is manipulated back and forth to clean the floor.

In the illustrated embodiment the canister assembly 52 includes a cavity adapted to receive and hold a dirt collection vessel in the form of a dirt cup 64. A suction generator 66, including a fan and motor assembly, may either be carried on the nozzle assembly 10 or the canister assembly 52. In either event the suction generator 66 draws air and entrained dirt and debris into the vacuum cleaner 50. The dirt and debris is collected from the air in the dirt cup 64 and clean air is then exhausted through a final filter (not shown) into the environment. The bagless vacuum cleaner illustrated may or may not take advantage of cyclonic technology.

While the illustrated vacuum cleaner 50 utilizes a dirt cup 64 as the dirt collection vessel, it should be appreciated that the vacuum cleaner could just as easily utilize a vacuum cleaner bag instead of the cup. Further, while the dirt cup 64 in the illustrated vacuum cleaner 50 is carried on the canister assembly 52, it should be appreciated that the dirt cup or even a bag could be just as easily carried on the nozzle assembly 10 if desired.

Figure 5:
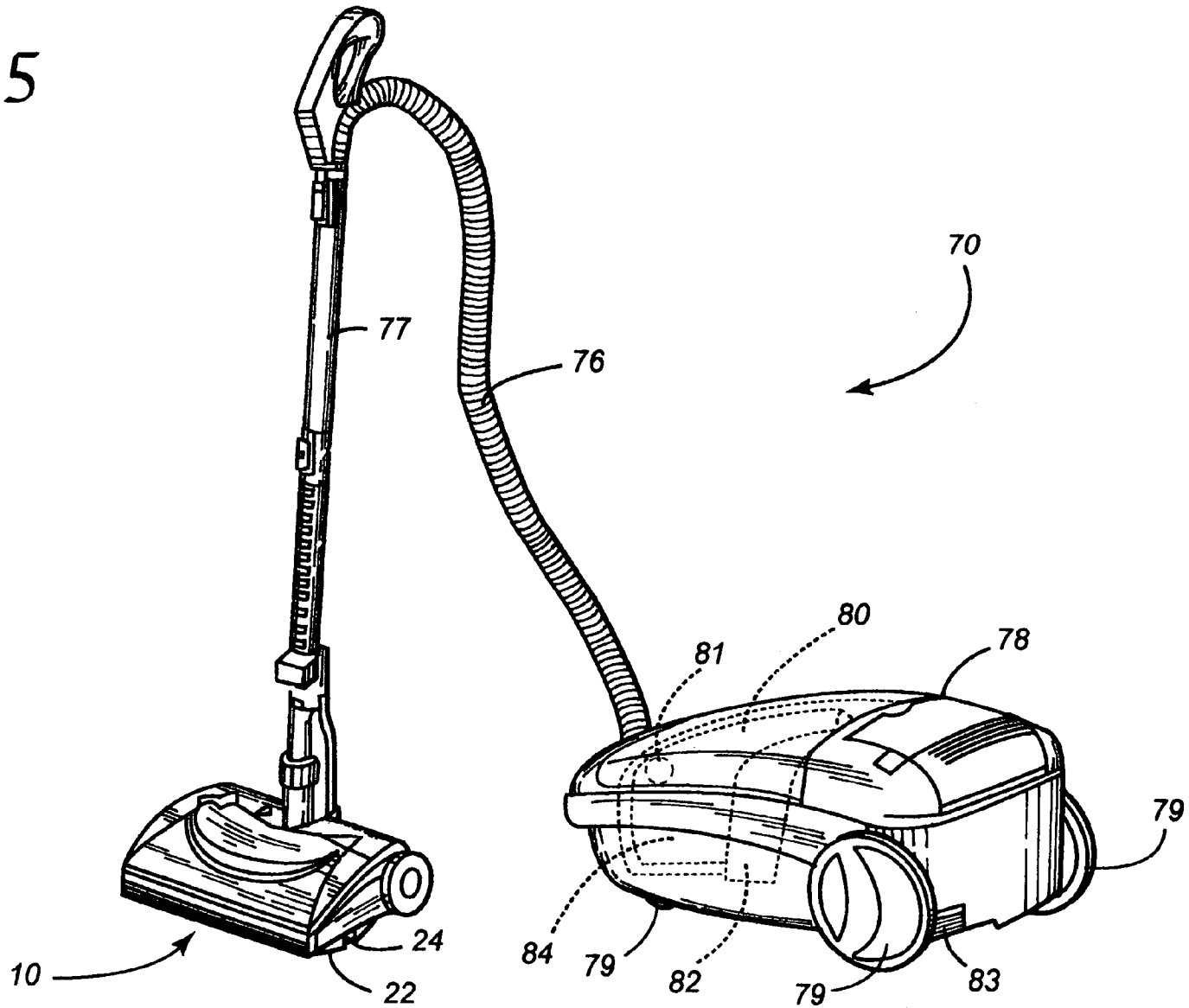
FIG. 5 is a perspective view of a canister vacuum cleaner including a power head an nozzle attachment both incorporating the features of the present invention.

FIG. 5 illustrates a canister vacuum cleaner 70 equipped with a nozzle assembly/power head 10 and alternative nozzle attachments (not shown) constructed in accordance with the teachings of the present invention and including the airflow channels 28. More particularly the canister vacuum cleaner 70 includes a hose 76, a wand 77 and a canister housing 78 supported on wheels 79. The canister housing 78 includes an internal chamber 80 as well as a suction inlet 81 and exhaust outlet 83. A suction generator 82, in the form of a fan and motor assembly, is held in the chamber 80. Additionally, a dirt collection vessel 84 in the form of a dust bag or dirt cup is held in the internal chamber 80 between the suction inlet 81 and the suction generator 82.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the channels 28 may be of different sizes and shapes. Further, additional channels 68 may be provided in the bottom wall 14. As illustrated in FIG. 1 these channels 68 extend from the sides of the nozzle assembly 10 to the intake opening 16 at a point between the two agitators 22, 24. These channels 68 function to direct air into the intake opening 16 between the agitators 22, 24 so as to increase the airflow in this zone and thereby enhance the capacity of that airstream to entrain dirt and carry that dirt toward the dirt collection vessel. While not apparent from the illustration, the channels 68 may also be shaped to provide a decreasing cross sectional area as those channels extend toward the intake opening 16 to aid in increasing the speed of the airstream.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed is:

1. A nozzle assembly for a suction cleaning device, comprising:

a body having an edge and a bottom wall, said bottom wall including an intake opening and a portion extending at least partially between said edge and said intake opening; and at least one channel in said portion extending between said edge and said intake opening, said at least one channel having a cross sectional area deceasing in a direction extending from said edge toward said intake opening whereby air drawn through said at least one channel is accelerated as said air approaches said intake opening.

2. The nozzle assembly of claim 1, wherein said at least one channel includes a top wall and a pair of converging sidewalls.

3. The nozzle assembly of claim 1, wherein s aid channel is a substantially truncated V-shape.

4. The nozzle assembly of claim 1, wherein said at least one channel includes a first end adjacent said edge and a second end adjacent said intake opening.

5. The nozzle assembly of claim 4, wherein said first end has a width $W_1$ and said second end has a width $W_2$ where $W_1>W_2$.

6. The nozzle assembly of claim 4, wherein said first end has a depth $D_1$ and said second end has a depth $D_2$ where $D_{1>D2}$.

7. The nozzle assembly of claim 1, wherein said at least one channel includes multiple channels.

8. The nozzle assembly of claim 7, wherein each channel of said multiple channels includes a top wall and a pair of converging sidewalls.

9. The nozzle assembly of claim 7, wherein each channel of said multiple channels is a substantially truncated V-shape.

10. The nozzle assembly of claim 7, wherein each channel of said multiple channels includes a first end adjacent said edge and a second end adjacent said intake opening.

11. The nozzle assembly of claim 10, wherein said first end has a width $W_1$ and said second end has a width $W_2$ where $W_1>W_2$.

12. The nozzle assembly of claim 10, wherein said first end has a depth $D_1$ and said second end has a depth $D_2$ where $D_1>D_2$.

13. The nozzle assembly of claim 10, wherein said portion has a width $W_3$ and said first ends of said multiple channels have a total combined width $W_4$ where $W_4$ is between about 400% to about 60% of $W_3$.

14. The nozzle assembly of claim 13, wherein said second ends of said multiple channels have a total combined width $W_5$ where $W_5$ is between about 22% to about 42% of $w_3$.

15. A method for increasing cleaning efficiency of a nozzle assembly including an intake opening, comprising:

providing an air inlet channel in the nozzle assembly for delivering air to the intake opening; and reducing a cross sectional area of said air inlet channel as said air inlet channel approaches said intake opening.

16. An upright vacuum cleaner, comprising:

a nozzle assembly having a bottom wall defining an intake opening a canister assembly pivotally connected to said nozzle assembly;

a suction generator mounted in one of said nozzle assembly and said canister assembly;

a dirt collection vessel mounted in one of said nozzle assembly and said canister assembly;

said nozzle assembly being characterized by at least one channel in said bottom wall in communication with said intake opening, said at least one channel having a cross sectional area decreasing in a direction extending toward said intake opening.

17. The upright vacuum cleaner of claim 16 further including a rotary agitator in said intake opening.

18. A power head, comprising:

a nozzle assembly having a bottom wall defining an intake opening;

a rotary agitator carried on said nozzle assembly and extending at least partially across said intake opening ; and at least one channel in said bottom wall in communication with said intake opening, said at least one channel having a cross sectional area decreasing in a direction extending toward said intake opening.

19. A nozzle attachment, comprising:

a nozzle body having a bottom wall defining an intake opening; and at least one channel in said bottom wall in communication with said intake opening, said at least one channel having a cross sectional area decreasing in a direction extending toward said intake opening.

* * * * *

UNITED STATES PATENT AND TRADEMARK OFFICE

CERTIFICATE OF CORRECTION

PATENT NO. : 7,210,197 B2
APPLICATION NO. : 10/806912
DATED : May 1, 2007
INVENTOR(S) : Fedorka et al.

It is certified that error appears in the above-identified patent and that said Letters Patent is hereby corrected as shown below:

Col. 6 claim 13, line 64, please replace “400%” with -- 40% --.

Signed and Sealed this

Third Day of July, 2007

JON W. DUDAS
*Director of the United States Patent and Trademark Office*